US007481745B2

(12) United States Patent
Malazinsky

(10) Patent No.: US 7,481,745 B2
(45) Date of Patent: Jan. 27, 2009

(54) FLOATING AQUATIC STAIR STEPPER

(75) Inventor: Dennis M. Malazinsky, Cape Coral, FL (US)

(73) Assignee: Dennis Malazinsky, Cape Coral, FL (US)

( * ) Notice: Subject to any disclaimer, the term of this patent is extended or adjusted under 35 U.S.C. 154(b) by 0 days.

(21) Appl. No.: 11/401,133

(22) Filed: Apr. 10, 2006

(65) Prior Publication Data

US 2007/0238581 A1 Oct. 11, 2007

(51) Int. Cl.
*A62B 31/00* (2006.01)

(52) U.S. Cl. ..... 482/55; 482/53; 472/129; 441/129

(58) Field of Classification Search ..... 482/51–55, 482/92, 111, 121, 122; 440/21, 25; 472/128, 472/129; 441/129–132
See application file for complete search history.

(56) References Cited

U.S. PATENT DOCUMENTS

| | | | | | |
|---|---|---|---|---|---|
| 2,317,905 | A | | 4/1943 | Galkin | |
| 2,976,835 | A | | 3/1961 | Germick | |
| 3,970,302 | A | * | 7/1976 | McFee | 482/53 |
| 4,241,688 | A | | 12/1980 | Mansolill et al. | |
| 4,496,147 | A | * | 1/1985 | DeCloux et al. | 482/53 |
| 4,733,858 | A | * | 3/1988 | Lan | 482/53 |
| 4,828,522 | A | | 5/1989 | Santos | |
| 4,900,012 | A | * | 2/1990 | Fu | 482/52 |
| 5,092,589 | A | | 3/1992 | Packer | |
| 5,267,922 | A | * | 12/1993 | Robinson | 482/53 |
| 5,328,423 | A | * | 7/1994 | Abboudi et al. | 482/53 |
| 5,368,507 | A | | 11/1994 | Harris | |
| 5,499,958 | A | * | 3/1996 | Hess | 482/79 |
| 5,509,831 | A | | 4/1996 | Gelbart | |
| 5,613,924 | A | * | 3/1997 | Lee | 482/51 |
| 5,643,020 | A | | 7/1997 | Harris | |
| 5,833,574 | A | * | 11/1998 | Hsieh | 482/51 |
| 6,106,439 | A | * | 8/2000 | Boland | 482/51 |
| 6,206,806 | B1 | * | 3/2001 | Chu | 482/53 |
| 6,991,588 | B1 | * | 1/2006 | Adams | 482/71 |

* cited by examiner

*Primary Examiner*—LoAn H. Thanh
*Assistant Examiner*—Tam Nguyen

(57) ABSTRACT

A floating aquatic stair stepper (1) having a frame (2) with support bars (6, 7), two extension legs (4) secured to the frame (2) and two foot placement steps (3) movably secured to each extension leg (4). The support bars (6, 7) permit a user to comfortably rest his or her hands, arms and shoulders, thereby permitting him or her to float. The foot placement steps (3) are each preferably slidably secured to extension legs (4). To use, a person raises and lowers each foot so as to simulate climbing stairs. The extension legs (4) may be fixedly secured to the frame (2) to provide for upward and downward movement only, or pivotally secured to the frame (2) to provide forward and backward movement of the legs as well. To further intensify the up and down movement of the present invention, resistance bands (5) may be used to secure the frame (2) to the foot placement steps (3).

4 Claims, 1 Drawing Sheet

FLOATING AQUATIC STAIR STEPPER

BACKGROUND OF THE INVENTION

This invention relates to stair steppers, more particularly, a floating aquatic stair stepper that promotes the rehabilitation, strengthening and exercising of the lower body.

After suffering a severe trauma to the body, many individuals must rehabilitate their muscles by performing various stretching and strengthening exercises in order to regain body movement and function. Although weight-bearing exercises have been the conventional method of rehabilitation, many individuals find the conventional method difficult, even when using a minimal amount of weight. In addition, the impact from performing such exercises causes pain, thereby demoralizing individuals to continue with the rehabilitation program.

Realizing such downfalls with traditional rehabilitation programs, aquatic therapy programs have quickly become a popular form of rehabilitation as there is little to no impact on the body due to the reduction in gravitational force. Because the buoyancy of water aids in motility and assists with the exercise, individuals seeking rehabilitation for musculoskeletal and neurological problems are encouraged to use aquatic therapy as there is little to no pain when various exercises are performed, thereby permitting the individual to exercise for an extended amount of time. Thus, the benefits of aquatic therapy are many, including improvement of muscle tone, strength and endurance, as well as the increasing of cardiovascular function, circulation, flexibility, range of motion, balance and coordination.

In addition, various aquatic therapy equipment may be used in conjunction with an aquatic therapy program in order to increase the strength of the body part that is injured. Currently, aquatic therapy equipment includes noodles and other floatation devices such as belts and collars, weights, boots, jump ropes, floating water bicycles and treadmills which rest on a pool bottom. Although the current aquatic therapy equipment aids in strengthening of various muscles, as a body can become accustomed to the same movement and motions that are repetitively performed, a person's rehabilitation level can plateau if he or she uses the same equipment or performs the same movement for an extended amount of time. Thus, a need for a new type of aquatic therapy equipment exists so as to provide a user more equipment options.

Currently, stair climbing machines, or stair steppers, are the third most popular cardiovascular machine in use. Stair steppers provide an excellent cardiovascular workout to build leg muscles and tone the buttocks. However, because stair steppers cause some impact to the joints, some individuals find it difficult to use such a machine.

Thus, a need exists for a floating aquatic stair stepper that permits a user to perform movement that simulates climbing stairs with minimal to no impact, thereby increasing strength in the lower body. In addition, not only could the floating aquatic stair stepper be used by individuals in aquatic therapy programs, but the floating aquatic stair stepper could be used by any individual who wishes to obtain a good workout.

The relevant prior art includes the following references:

| U.S. Pat. No. (U.S. unless stated otherwise) | Inventor | Issue/Publication Date |
|---|---|---|
| 4,828,522 | Santos | May 9, 1989 |
| 5,509,831 | Gelbart | Apr. 23, 1996 |

-continued

| U.S. Pat. No. (U.S. unless stated otherwise) | Inventor | Issue/Publication Date |
|---|---|---|
| 2,317,905 | Galkin | Apr. 27, 1943 |
| 2,976,835 | Germick | Mar. 28, 1961 |
| 5,368,507 | Harris | Nov. 29, 1994 |
| 5,643,020 | Harris | Jul. 1, 1997 |
| 5,092,589 | Packer | Mar. 3, 1992 |
| 4,241,688 | Mansolill et al. | Dec. 30, 1980 |

SUMMARY OF THE INVENTION

The primary object of the present invention is to provide a floating aquatic stair stepper that permits a person to exercise the lower body with minimal impact.

Another object of the present invention is to provide a floating aquatic stair stepper that is easy to use.

A further object of the present invention is to provide a floating aquatic stair stepper that promotes strength and endurance in the lower body.

An even further object of the present invention is to provide a floating aquatic stair stepper that aids in repairing musculoskeletal and neurological damage.

Another object of the present invention is to provide a floating aquatic stair stepper that is buoyant.

The present invention fulfills the above and other objects by providing a floating aquatic stair stepper having a frame, at least one extension leg secured to the frame and at least one foot placement step secured to each extension leg. The frame permits a user to comfortably rest his or her shoulders and arms on the stair stepper, thereby permitting him or her to float. The present invention may provide for three different motions, depending upon how the at least one extension leg and at least one foot placement step are secured. A first up and down, stair-like motion is achieved when the at least one extension leg is fixedly secured to the frame and the at least one foot placement step is slidingly secured to the at least one extension leg. A second up and down, back and forth motion is achieved when the at least one extension leg is pivotally secured to the frame and the at least one foot placement step is slidingly secured to the at least one extension leg. A final back and forth motion is achieved when the at least one extension leg is pivotally secured to the frame and the at least one foot placement step is fixedly secured to the at least one extension leg. In addition, to further intensify the up and down movement of the present invention, resistance bands may be used to secure the frame to the foot placement steps.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
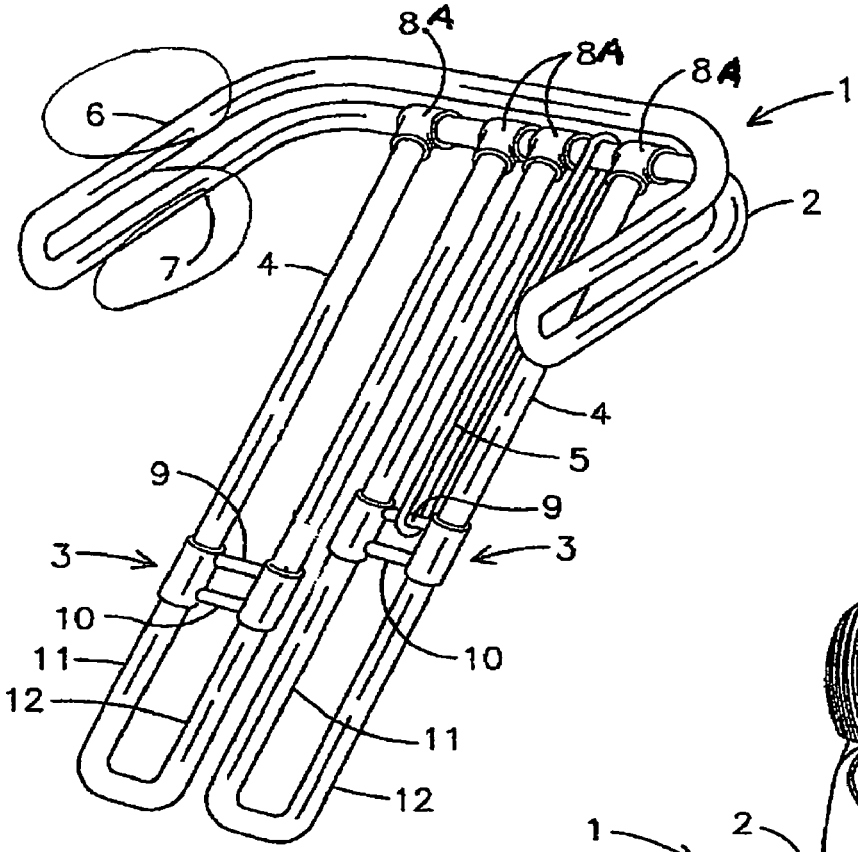
FIG. 1 is a perspective view of the present invention with an optional resistance band.

For purposes of describing the preferred embodiment, the terminology used in reference to the numbered components in the drawings is as follows:

| | |
|---|---|
| 1. | floating aquatic stair stepper |
| 2. | frame |
| 3. | foot placement step |
| 4. | extension legs |
| 5. | resistance band |
| 6. | upper support bar |
| 7. | lower support bar |
| 8. | tube |
| 8a. | tubular joint |
| 9. | upper section |
| 10. | lower section |
| 11. | left bar |
| 12. | right bar |
| 13. | water |
| 14. | up and down motion |
| 15. | back and forth motion |

With reference to FIG. 1, a perspective view of the of the present invention with an optional resistance band is shown. The floating aquatic stair stepper 1 includes a frame 2, at least one extension leg 4 and at least one foot placement step 3. The frame 2 is preferably constructed so as to include an upper support bar 6 and a lower support bar 7 so as to permit the floating aquatic stair stepper 1 to float in water while permitting a user to have his/her upper body above the water while resting his or her hands, arms and shoulders on the support bars 6 and 7. In this manner, the lower support bar 7 provides the stability and buoyancy needed to achieve a non-impact workout while the upper support bar 6 permits the user to hold onto the floating aquatic stair stepper 1.

The extension legs 4 are secured to the frame 2, preferably by tubular joints 8(*a*) that permit for pivotal forward and backward movement of the extension legs 4 about the lower support bar 7 of the frame 2. The extension legs 4 each preferably have a left bar 11 and a right bar 12 and are also preferably U-shaped, although other extension leg shapes may be utilized.

Located on the extension legs 4 are foot placement steps 3 that are preferably slidingly secured, but may be fixed, on the left bar 11 and right bar 12 of the extension legs 4. The foot placement steps 3 include an upper section 9 and a lower section 10, each of which are preferably horizontal and are connected to one another via tubes 8. The lower section 10 is preferably wide so as to accommodate a variety of foot sizes. The tubes 8 surround the left bar 11 and the right bar 12 and are sized slightly larger in diameter than the width of the left and right bars 11 and 12 to permit upward and downward movement of the foot placement steps 3.

At least one resistance band 5 may be secured to the frame 2 and the foot placement steps 3 to increase the workout difficulty. A user may use resistance bands 5 of minimal resistance if he or she is beginning therapy and increase the level of resistance of the band and/or increase the number of bands utilized as he or she becomes stronger.

Figure 2:
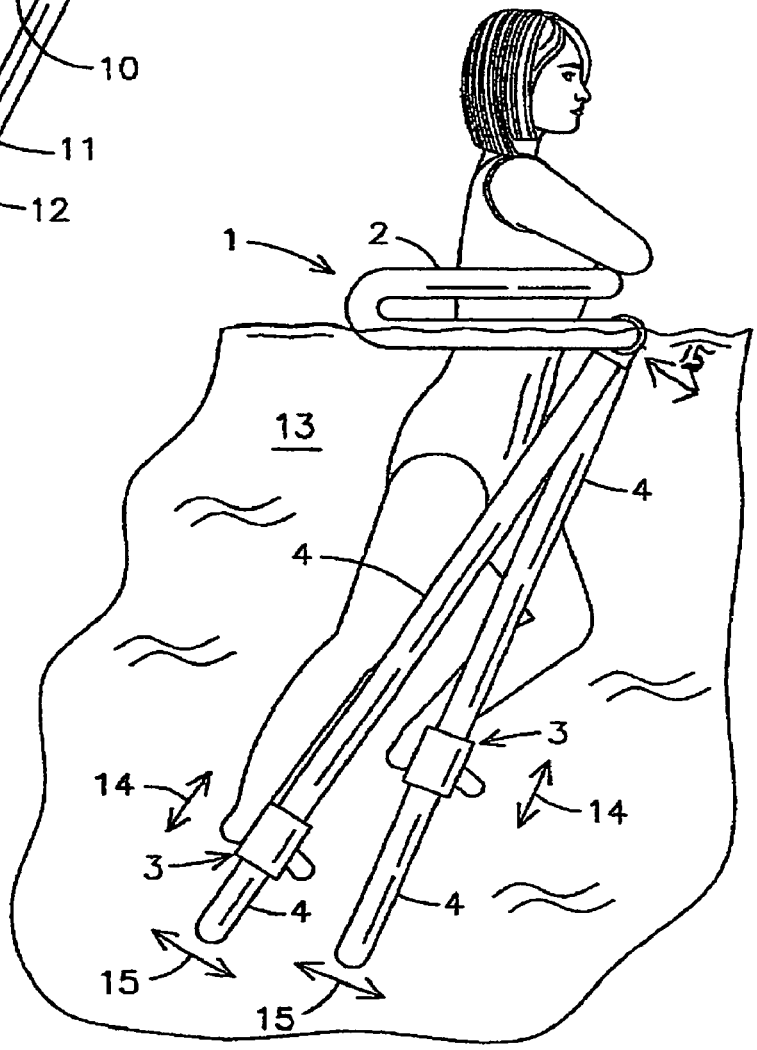
FIG. 2 is a side view of the present invention in use.

In FIG. 2, a side view of the present invention in use is shown. To use the floating aquatic stair stepper 1, a user first places the stepper 1 in the water 13 so as to allow the aquatic stair stepper 1 to float in the water 13. Then, the user places his or her feet into the foot placement steps 3 so as to rest his or her foot on the lower section 10. The user begins to exercise by pressing one of his or her feet downward on the lower section 10 so as to straighten the leg while lifting the opposite foot so as to bend the opposing leg in a motion that is similar to that used on conventional stair steppers or when climbing stairs. When pushing downward, the leg and buttocks muscles are strengthened due to the water resisting the movement of the foot placement step 3. When the foot is lifted upward, the top of the foot is adjacent to the top section 9, thereby moving the foot placement step 3 in an upward direction along the extension leg 4. Because the water also resists the upward movement of the foot placement step 3 as well, not only are the leg and buttocks muscles being exercised when the legs are straightened during the downward motion, but they are also being exercised when the legs are being bent during the upward motion. Thus, the user receives maximum results as he or she is working out the muscles in an up and down motion 14 of the steps.

In addition, the hips may receive a workout when the extension legs 4 of the present invention are pivotally secured to the frame 2. As shown in FIG. 2, not only may the foot placement steps 3 be raised and lowered, but the user may also swing his or her legs so as to cause a back and forth motion 15 of the extension legs 4.

A final third motion may also be achieved wherein the extension legs 4 are pivotally secured to the frame 2 and the foot placement steps 3 are fixedly secured to the extension legs 4. In this manner, the user achieves only a back and forth motion 15 during his or her workout.

Because the floating aquatic stair stepper 1 is made of buoyant materials, such as PVC pipe filled with foam, the stepper 1 does not sink to the bottom of the water 13. In addition, because the frame 2 is preferably sized and shaped so as to provide a large surface area, a user may rest on the frame 2 or hold onto the frame 2 without the stepper 1 sinking or tipping. Finally, because the stepper 1 is preferably made of a rigid material, it is able to withstand much use.

The use of the present invention will promote the rehabilitation, strengthening and exercising of the lower body without the impact and jarring motion traditionally caused by using exercise equipment on land.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not be considered limited to what is shown and described in the specification and drawings.

Having thus described my invention, I claim:

1. A floating aquatic stair stepper comprising:

a buoyant tubular frame, adapted to float in water while supporting a user in an upright position, having an upper support bar and a lower support bar each having a substantially "C" shape configuration with the upper support bar being substantially disposed directly above and parallel to the lower support bar;

a pair of elongated "U" shape tubular legs pivotally and adjustably secured at one end thereof to a middle portion of the lower support bar;

a rigid foot placement step slidably secured to each said leg and adapted to receive a foot of the user; and at least one resistance band interconnected between the lower support bar and each foot placement step wherein each foot placement step includes an upper tube and a lower tube configured horizontally parallel to each other with both ends of the upper and lower tube being coupled perpendicularly to a pair of tubes that are slidably secured to one of said legs.

2. The floating aquatic stair stepper of claim 1 wherein at least one of said leg is fixedly secured to the lower support bar.

3. The floating aquatic stair stepper of claim 1 wherein at least one of said foot placement step is fixedly secured to a respective one of said leg.

4. The floating aquatic stair stepper of claim 1 wherein said frame is made from PVC pipe filled with foam.

* * * * *